US009273911B2

(12) United States Patent
Vännman et al.

(10) Patent No.: US 9,273,911 B2
(45) Date of Patent: Mar. 1, 2016

(54) PLATE, HEAT EXCHANGER AND METHOD OF MANUFACTURING A HEAT EXCHANGER

(75) Inventors: Erik Vännman, Pixbo (SE); Olivier Noël-Baron, Echirolles (FR)

(73) Assignees: ALFA LAVAL CORPORATE AB, Lund (SE); ALFA LAVAL VICARB, Fontanil Cornillon (FR)

( * ) Notice: Subject to any disclaimer, the term of this patent is extended or adjusted under 35 U.S.C. 154(b) by 1263 days.

(21) Appl. No.: 13/142,402

(22) PCT Filed: Dec. 11, 2009

(86) PCT No.: PCT/EP2009/066969

§ 371 (c)(1), (2), (4) Date: Sep. 22, 2011

(87) PCT Pub. No.: WO2010/076160

PCT Pub. Date: Jul. 8, 2010

(65) Prior Publication Data

US 2012/0000637 A1 Jan. 5, 2012

(30) Foreign Application Priority Data

Dec. 29, 2008 (EP) ..... 08306026

(51) Int. Cl.
*F28F 3/04* (2006.01)
*F28D 9/00* (2006.01)

(52) U.S. Cl.
CPC ..... *F28F 3/046* (2013.01); *F28D 9/0037* (2013.01); *Y10T 29/4935* (2015.01)

(58) Field of Classification Search
CPC ..... F28F 3/046; F28F 3/025; F28F 3/04; F28D 9/0037; F28D 9/0025; Y10T 29/4935; Y10T 29/49366; Y10T 29/49368; Y10T 29/49393; B21D 39/028; B23K 1/0014; B23K 11/0093; B23K 11/0026; B23K 2201/02; B23K 2201/04; B23K 2201/14; B23P 2700/12; B23P 15/26
See application file for complete search history.

(56) References Cited

U.S. PATENT DOCUMENTS 3,887,664 A 6/1975 Regehr
3,931,854 A 1/1976 Ivakhnenko et al.
(Continued)

FOREIGN PATENT DOCUMENTS

CN 1606682 A 4/2005
EP 0658735 6/1995
(Continued)

OTHER PUBLICATIONS

English Translation of JP 20080911 A to Toyoaki Matsuzaki.*
(Continued)

*Primary Examiner* — Jason L Vaughan
(74) *Attorney, Agent, or Firm* — Buchanan Ingersoll & Rooney PC

(57) ABSTRACT

Plate (1) intended to form a partition between two fluids circulating inside a welded heat exchanger, the plate (1) having a plurality of undulations (2) characterized in that all or part of the undulations (2) has, on at least one upper crest line (3), at least one preferred contact area (4) that has a height above a nominal height of the undulations (2) of the plate (1), the at least one preferred contact area (4) being intended to come into contact with a lower crest line of an undulation of another plate provided above the plate (1) and to be deformed when the exchanger is manufactured.

10 Claims, 1 Drawing Sheet

(56) References Cited

U.S. PATENT DOCUMENTS

| | | | | |
|---|---|---|---|---|
| 4,180,129 | A | 12/1979 | Sumitomo | |
| 4,706,741 | A * | 11/1987 | Bolmstedt et al. | 165/115 |
| 5,413,872 | A * | 5/1995 | Faigle | 428/603 |
| 5,806,584 | A | 9/1998 | Thonon et al. | |
| 6,131,648 | A | 10/2000 | Rasmussen | |
| 6,662,862 | B1 | 12/2003 | Lindholm | |
| 7,104,315 | B2 | 9/2006 | Blomgren | |

FOREIGN PATENT DOCUMENTS

| | | | |
|---|---|---|---|
| EP | 1 063 486 | A1 | 12/2000 |
| FR | 2 283 783 | A1 | 4/1976 |
| JP | 49-20742 | A | 2/1974 |
| JP | 50-55952 | A | 5/1975 |
| JP | 58-90056 | A | 5/1983 |
| JP | 01-503254 | A | 11/1989 |
| JP | 07-324886 | | 12/1995 |
| JP | 09-511565 | A | 11/1997 |
| JP | 2000-508751 | | 7/2000 |
| JP | 2000-508751 | A | 7/2000 |
| JP | 2002-048491 | A | 2/2002 |
| JP | 2005-514576 | A | 5/2005 |
| JP | 2008-209073 | | 9/2008 |
| WO | 88/08508 | A1 | 11/1988 |
| WO | 97/39301 | | 10/1997 |
| WO | 03/058142 | | 7/2003 |
| WO | 03/069249 | | 8/2003 |

OTHER PUBLICATIONS

Office Action for Japanese Patent Application No. 2011-542757 dated Nov. 13, 2012 in English.

An English Translation of the First Office Action issued Nov. 13, 2012, by the Japanese Patent Office in corresponding Japanese Patent Application No. 2011-542757. (3 pages).

Search Report issued Jan. 5, 2013, by the Chinese Patent Office in corresponding Chinese Patent Application No. 200980153828.8. (2 pages).

English language translation of Office Action issue on Aug. 25, 2014, (Notice of Preliminary Rejection) by the Korean Patent Office in corresponding Korean Patent Application No. 10-2013-7014808 (2 pages).

* cited by examiner

PLATE, HEAT EXCHANGER AND METHOD OF MANUFACTURING A HEAT EXCHANGER

TECHNICAL FIELD

The invention relates to the field of heat exchangers inside which two fluids are circulating one receiving the heat energy of the other. In such exchangers, the fluids can be of the liquid or gaseous type. These fluids circulate between plates that have an optimum exchange surface and a reduced space requirement by means of undulations on either side of a median plane.

The invention more particularly targets a type of plate whereof the geometry facilitates the assembly of exchangers with weld assembled plates. This kind of plate welding can be done with or without filler metal or again using a brazing solder.

PRIOR ART

In general terms, plates are known that have undulations whereof the upper crest lines of a first plate come into contact with the lower crest lines of a second plate located above. However, when the plates have a ledge which is placed in a facing position in order to commence the welding assembly, two problematic situations are generally noted by the operator.

Indeed, in a first scenario, it is possible for the two plates to come into contact with each other on their edge without the undulations touching each other. The undulations in this situation have a height below their nominal height. So, when a pressure force is exerted on the plates, their edges may overlap locally and the welding bead may well be uneven and not rectilinear in these edge overlay areas.

Furthermore, in the second scenario where the undulations have a height above their nominal height, the edges of the plates no longer come into contact with each other and the welding becomes complex to perform. Leakproofing problems then arise and it is necessary to restart the welding in order to avoid any leaks. Another solution comprises disassembling the plates of the exchanger and then lowering the height of the undulations in such a way as to make the edges correspond with each other.

The purpose of the invention therefore is to allow a simplified design of welded plate heat exchangers in such a way as to guarantee that the plates can easily be assembled with each other.

A second objective of the invention is to guarantee a perfectly leakproof join by welding between the plates.

DISCLOSURE OF THE INVENTION

The invention therefore relates to a plate intended to form a partition between two fluids circulating inside a welded heat exchanger, such a plate comprising a plurality of undulations.

According to the invention, the plate is characterised in that all or part of the undulations comprises, on at least one upper crest line, at least one preferred contact area that has a height above the nominal height of the plate undulations. This preferred contact area is intended to come into contact with a lower crest line of an undulation of another plate provided above the first plate and to be deformed during manufacture of the exchanger.

In other words, the undulations have localised bumps intended to be deformed when the plates are pressurised against each other. Such a deformation therefore makes it possible to compensate locally for the deviations in the height of the undulations and to adjust the edges of the plates to be welded to each other. Indeed, by compressing the preferred contact areas, it is possible to bring the edges of the plates closer to each other in order to allow them to be secured by welding.

To advantage, the upper crest line may comprise preferred contact areas spaced out with a constant pitch. In this way, the preferred contact areas are distributed evenly on the surface along a crest line of an undulation.

According to a particular embodiment, the pitch separating two preferred contact areas may be equal to the pitch separating two undulations.

In this situation, the preferred contact areas are distributed in such a way as to correspond with each of the successive undulations of the upper plate.

In practice, the preferred contact areas may be distributed in at least one continuous strip. Such a strip is generally of narrow width which remains constant on the surface of the plate. The preferred contact areas may thus also be distributed along line segments inscribed in these strips.

According to one advantageous embodiment, the plate may comprise a first strip provided on the plate periphery. Indeed, this arrangement is advantageous so as to allow the adjustment of the distance separating the edges of the plates welded to each other.

Moreover, the plate can also comprise a second strip provided in a main thermal exchange area of the exchanger. In this situation, vibrations between plates are limited with a consequent reduction in the wear they sustain through fatigue and in the related failure hazards.

To advantage, the preferred contact areas may be provided on undulations positioned in a main thermal exchange area of the exchanger. Such an area generally comprises undulations inclined at 45° relative to the longitudinal direction of the plates. Such an arrangement favours a large contact surface between the two plates.

According to one particular embodiment, the preferred contact areas may comprise a length of between 5 and 20 mm. In this way, the positioning of a contact area opposite an undulation on an upper plate is guaranteed, irrespective of geometric deviations in manufacture.

In practice, the preferred contact areas may comprise a height of between 0.05 and 1 mm, and preferentially between 0.10 and 0.50 mm and more preferentially between 0.15 and 0.25 mm. Such a height makes it possible to take up the play between the plate edges for welding and thereby to position the edges of the plates opposite one another. Furthermore, such a height may be a function of the dimensions of the plates forming the exchanger and the pressure allowing these preferred contact areas to be deformed may be adapted as a function of the number of contact points and of the height selected.

The invention also relates to a welded heat exchanger, which is characterised in that it comprises at least one plate as previously described.

It also relates to a method of manufacturing a welded plate exchanger. According to the invention, this manufacturing method is characterised in that it comprises steps of:

- deforming preferred contact areas provided on an upper crest line of at least one undulation of a first plate on coming into contact with a lower crest line of an undulation of a second plate provided above the first plate, the contact areas having, prior to deformation, a height above a nominal height of the undulations of the first plate;
- welding the edges of the first and second plates to each other.

In other words, such a method comprises a step wherein a pressure force is exerted on the plates in such a way as to deform the preferred contact areas in order to bring the edges opposite one another.

In this way, plates are used whereof the undulations comprise, on an upper crest, at least one deformable area whereof the height is above the nominal height of the plate undulations. In doing this, the positioning of the plate edges is adjusted accurately and the welding process then commences by welding the edges.

BRIEF DESCRIPTION OF THE FIGURES

The method for implementing the invention and the advantages deriving therefrom will emerge from the following embodiment description, given by way of information and non-restrictively, supported by the figures wherein.

DETAILED DESCRIPTION OF THE INVENTION

As already mentioned, the invention relates to a plate forming a partition between two fluids inside a welded heat exchanger.

Figure 1:
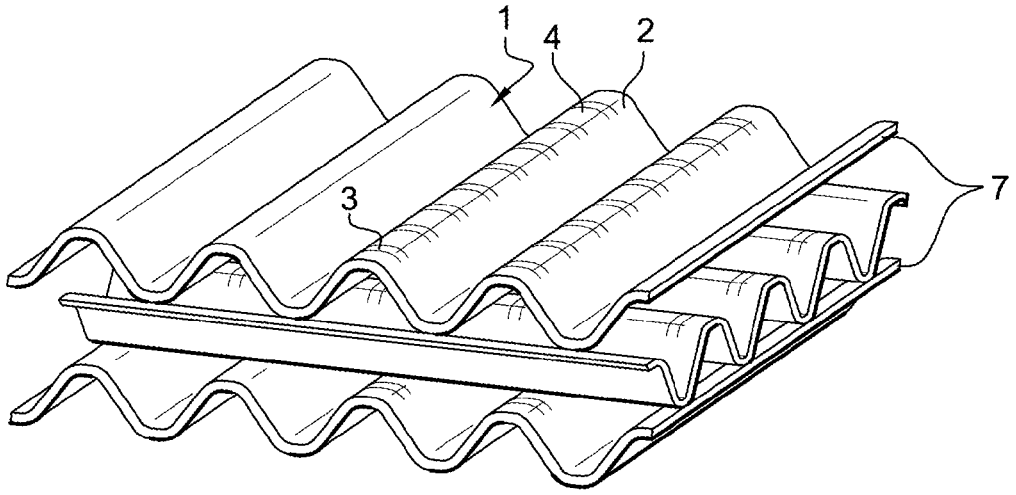
FIG. 1 is a perspective view of a stack of plates in accordance with the invention.

As shown in FIG. 1, such a plate 1 has a plurality of undulations 2. In accordance with the invention, at least one of these undulations 2 has on an upper crest line 3 preferred contact areas 4 whereof the height is above the nominal height of the undulations 2. When manufacturing the exchanger all or part of these preferred contact areas 4 are compressed in such a way as to line up the plate edges opposite one another.

As shown, these preferred contact areas 4 may be evenly spaced apart with a pitch substantially equal to the pitch of the plate undulations.

Furthermore, the height of these preferred contact areas is between 0.05 and 1 mm relative to the nominal height of the plate undulations.

Figure 2:
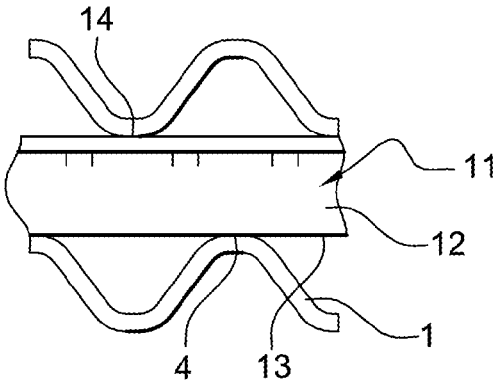
FIG. 2 is a cross-section view of three stacked plates in accordance with the invention.

As shown in FIG. 2, the preferred contact area 4 engages with a lower crest line 13 of an undulation 12 of a second plate 11 positioned above the first plate 1. Likewise, the second plate 11 has preferred contact areas 14 engaging with an upper plate.

Moreover, in order to guarantee the engagement between the preferred contact areas 4 of a first plate 1 with a lower crest line 13 of an undulation 12 of a second plate 11, it is advantageous for the width of the preferred contact areas 4 to be less than twice the pitch separating the undulations 12.

By way of example, the preferred contact areas may have a width of between 5 and 20 mm in such a way as to ensure that the upper undulation bears fully on this contact area.

Figure 3:
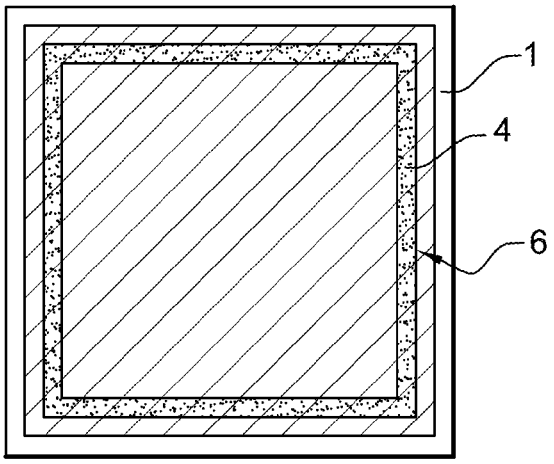
FIGS. 3 and 4 are views from above according to two alternatives of the plate.

As shown in FIG. 3, a plate 1 may comprise preferred contact areas 4, distributed in a strip 6 extending in proximity to the periphery of the plate 1. In this way, it is possible to adjust the spacing between the edges of the plates to be welded to each other by exerting a reduced pressure force on the plates to be assembled by welding.

Figure 4:
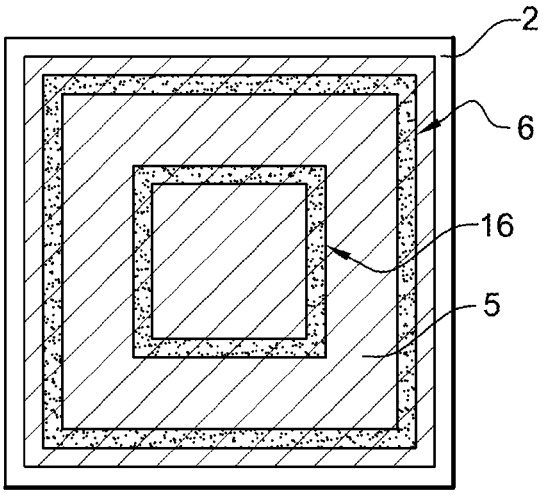

As shown in FIG. 4, the plate 1 may also comprise preferred contact areas 4, distributed along two strips 6,16 extending both on the periphery and in the centre of the plate 1. Thus, the first strip 6 allows an adjustment of the spacing between the edges 7 of the plates to be welded to each other by exerting a reduced pressure force on the plates to be assembled by welding, while the second strip 16 allows a reduction in the vibrations in the plates thereby increasing the fatigue resistance of the exchanger.

This central area of the exchanger may also correspond with a main exchange area 5 of the exchanger. In this main exchange area, the undulations may in particular be inclined at 45° along a main direction of the flux circulating between two plates.

What emerges from the aforegoing is that a plate, a heat exchanger and a method of manufacturing this exchanger have many advantages and in particular:

- they make it easier to weld the plate edges to each other;
- they do not require any special equipment;
- they do not generate any additional costs relative to existing solutions wherein an adjustment of the distance of the edges is not always possible or straightforward.

What is claimed is:

1. A method of manufacturing a welded heat exchanger, the heat exchanger comprising at least first and second plates, with a plurality of undulations on the first plate and a plurality of undulations on the second plate, comprising:

deforming preferred contact areas provided on an upper crest line of at least one undulation of a first plate on coming into contact with a lower crest line of an undulation of a second plate provided above said first plate, the one undulation of the first plate being one of a plurality of undulations that extend continuously across the first plate, and the one undulation of the second plate being one of a plurality of undulations that extend continuously across the second plate, said preferred contact areas having, prior to deformation, a height above a nominal height of the undulations of the first plate, the deformation of the preferred contact areas compensating for deviations in heights of the undulations extending across the first and second plates and moving edges of the first and second plates towards one another; and welding the edges of the first and second plates to each other.

2. The method as claimed in claim 1, wherein the preferred contact areas on the upper crest line are spaced apart by a constant pitch.

3. The method as claimed in claim 2, wherein the first plate comprises a plurality of undulations, and wherein two preferred contact areas on the upper crest line are separated by a pitch equal to the pitch separating two of the undulations of the first plate.

4. The method as claimed in claim 1, wherein the deforming of the preferred contact areas comprises deforming preferred contact areas that are distributed in at least one continuous strip.

5. The method as claimed in claim 4, wherein the plate possesses a periphery and wherein the deforming of the preferred contact areas that are distributed in at least one continuous strip comprises deforming preferred contact areas that are distributed in at least one continuous first strip on the periphery of the first plate.

6. The method as claimed in claim 5, further comprising deforming preferred contact areas distributed in a second strip provided in a main thermal exchange area of the first plate.

7. The method as claimed in claim 1, wherein the deforming of the preferred contact areas provided on the upper crest line of at least one undulation of the first plate includes deforming preferred contact areas that comprise a length of between 5 and 20 mm.

8. The method as claimed in claim 1, wherein the at least one undulation of the first plate includes a plurality of undulations each possessing a nominal height, and wherein the deforming of the preferred contact areas provided on the upper crest line of at least one undulation of the first plate includes deforming preferred contact areas that exceed the nominal height of the undulations by 0.05 to 1 mm.

9. The method as claimed in claim 1, wherein the at least one undulation of the first plate includes a plurality of undulations each possessing a nominal height, and wherein the deforming of the preferred contact areas provided on the upper crest line of at least one undulation of the first plate includes deforming preferred contact areas that exceed the nominal height of the undulations by 0.1 to 0.5 mm.

10. The method as claimed in claim 1, wherein the at least one undulation of the first plate includes a plurality of undulations each possessing a nominal height, and wherein the deforming of the preferred contact areas provided on the upper crest line of at least one undulation of the first plate includes deforming preferred contact areas that exceed the nominal height of the undulations by 0.15 to 0.25 mm.

* * * * *